US005356146A

United States Patent [19]

Blosser

[11] Patent Number: 5,356,146

[45] Date of Patent: Oct. 18, 1994

[54] GAUGED GOLF TEE

[76] Inventor: Daniel W. Blosser, Bellevue Branch, Wilmer Ave., Richmond, Va. 23227

[21] Appl. No.: 45,809

[22] Filed: Apr. 9, 1993

[51] Int. Cl.[5] ..... A63B 69/36

[52] U.S. Cl. ..... 273/187.1; 273/187.1

[58] Field of Search ..... 273/202, 33, 187.1

[56] References Cited

U.S. PATENT DOCUMENTS

| | | | |
|---|---|---|---|
| 1,553,561 | 9/1925 | Scott | 273/33 |
| 1,554,321 | 9/1925 | Banigan | 273/33 |
| 2,530,088 | 11/1950 | Smith | 273/33 |
| 3,114,557 | 12/1963 | Cabot | 273/33 |
| 3,203,700 | 8/1965 | Antonious | 273/202 |
| 3,408,079 | 10/1968 | Kirikos | 273/202 |
| 3,467,390 | 9/1969 | Gardiner | 273/187.1 |
| 4,515,780 | 5/1985 | Tabet | 273/202 |
| 5,085,431 | 2/1992 | McGuire | 273/33 |

*Primary Examiner*—George J. Marlo
*Attorney, Agent, or Firm*—John F. C. Glenn

[57] ABSTRACT

Golf tee having successive contrasting color stripes around most of its length to help a golfer to determine at a glance how many of the stripes are exposed above the ground in which the tee is set, and thereby determine the height of a golf ball on the tee above the ground. The stripes are arranged in repeated sequences of two or more different colors in each sequence.

1 Claim, 6 Drawing Sheets

GAUGED GOLF TEE

FIELD OF INVENTION

The present invention relates to golf tees and to means for estimating how high they may be teeing up golf balls, thereby enabling a golfer to adjust the trajectory of a ball's flight when so desired.

BACKGROUND OF THE INVENTION

The tee shot is the most important shot in the game of golf. Driving the ball poorly and inconsistently is a problem that plagues all golfers. One of the factors that causes this problem is improper tee depth. Often golfers do not place the tee far enough into the ground, inadvertently teeing the ball too high, causing them to strike the bottom portion of the ball or "sky" it. Conversely, golfers often place the tee too far into the ground, inadvertently teeing the ball too low, causing them to hit the top portion of the ball, or "top" it. Each scenario results in a poorly hit tee shot.

Therefore, inventors have created several types of tees designed to help the golfer consistently gauge the proper tee height. However, all of these devices appear (a) too clumsy and impractical to use and/or (b) too complicated and expensive to manufacture.

U.S. Pat. No. 1,553,561 to Scott (1925) discloses a tee that has one definite stop so that the same exact height may be attained each time. This is not an effective solution. Due to differences in golf swings from person to person, not all golfers tee the ball up at the same height. The proper tee height for one golfer is most likely the improper tee height for another. What Scott suggests is to manufacture at least two different tees; the high tee and the medium tee. This still does not provide the multiple tee height flexibility that golfers need. If a particular golfer desired a tee height which was not manufactured, it would have to be custom-made to accommodate his/her specific need. In addition, it's obviously more costly to manufacture many different versions of an invention instead of just one. Likewise, it is impractical to provide custom tees when one standard gauged tee can achieve the desired result and more.

U.S. Pat. No. 2,530,088 to Smith (1950) is an adjustable tee that is not inserted into the ground but placed on top of it. First, even though the tee appears to be adjustable, there is no gauge or constant that enables the golfer to be confident he/she is setting the ball at his/her correct height. Secondly, this tee by Smith is impractical because it appears to be difficult and clumsy to reset quickly and precisely if the golfer so desires. In addition, this tee is difficult to store away without changing a golfer's preferred setting. The same applies to another adjustable above the ground tee by Banigan, U.S. Pat. No. 1,554,321 (1925).

Several types of adjustable collared tees have been proposed-for example, U.S. Pat. No. 3,114,557 to Cabot (1963), U.S. Pat. No. 3,203,700 to Antonious (1965), and U.S. Pat. No. 3,408,079 to Kirikos (1968). All employ the use of a second part, an adjustable collar or stop member that moves up and down the main body of a notched tee. The collar is positioned in any one of the notched spaces. All of these tees suffer from a number of disadvantages, such as:

(a) Clumsy to adjust quickly if a change is desired once the tee is initially placed in the ground.

(b) Limited in adjustability. A golfer can only set the ring where notched. The golfer cannot set collars between the notched areas.

(c) Costly to manufacture. The additional part(s) add additional manufacturing costs.

(d) The collar, if not not locked specifically into one of the notches on the tee could easily be lost.

(e) Compared to the standard tee of today the life span of these tees is much less. The notches appear to create a much more fragile tee. The inverted notches decrease the strength and integrity of the tee, creating one that is easier to break.

U.S. Pat. No. 3,467,390 by Gardiner (1969) shows an adjustable golf tee that incorporates no fewer than five parts including a target member that could actually hamper a golfer's ability to make square contact with the golf ball.

U.S. Pat. No. 4,516,780 by Tabet (1985) shows a two-part adjustable tee does not have reference points that enable the golfer to gauge with consistency the height at which the ball should be teed. Therefore this tee is no more beneficial than that of the traditional non-gauged standard golf tee, and has the disadvantage of multiple parts.

SUMMARY OF THE INVENTION

The present invention preferably uses a unitary form of tee and provides a series of stripes of contrasting colors around the tee suitable for facilitating an accurate estimate of the height of a teed-up golf ball by observing how the stripes appear relative to the ground. Several objects and advantages of my invention are:

(a) to provide a golf tee that enables golfers to ascertain whether or not they've chosen the correct height in which to tee the ball.

(b) to provide a golf tee that enables golfers to have more confidence with their tee shots.

(c) to provide a golf tee that enables golfers to consistently tee the ball at the same height if desired from hole to hole and golf course to golf course.

(d) to provide a golf tee that enables golfers to effectively adjust to varying atmospheric and weather conditions (i.e., wind, precipitation, altitude, etc.).

(e) to provide a golf tee that enables golfers to more effectively control the distance their tee shots roll.

(f) to provide a golf tee that enables a golfer to adapt to varying course conditions (i.e., moisture content of the ground, design and layout, natural obstructions, etc).

(g) to provide a golf tee that enables golfers to control the height of their tee shot.

(h) to provide golfers with a gauged golf tee that is easy to use.

(i) to provide golfers with a gauged golf tee that incorporates no additional parts.

(j) to provide a gauged golf tee that is easy and inexpensive to manufacture.

(k) to provide a golf tee that is brightly colored.

(l) to provide a brightly colored tee that is functional.

(m) to provide a gauged tee that can be used effectively by all golfers, regardless of the type of golf swing they employ.

Further objects and advantages are to provide a golf tee that helps simplify the complex game of golf and make it easier and more fun to play. Still further objects and advantages are to provide a gauged golf tee that is no easier to break than the presently used standard non-gauged tee, and to provide a gauged golf tee that is used the same easy and convenient way of the standard non-gauged tee. Other objects and advantages will become apparent from the ensuing description and drawings.

BRIEF DESCRIPTION OF THE DRAWINGS

Present preferred embodiments of the invention are shown, for purposes of illustration only, in the accompanying drawings, in which.

DETAILED DESCRIPTION OF PRESENT PREFERRED EMBODIMENTS OF THE INVENTION

Figure 1C:
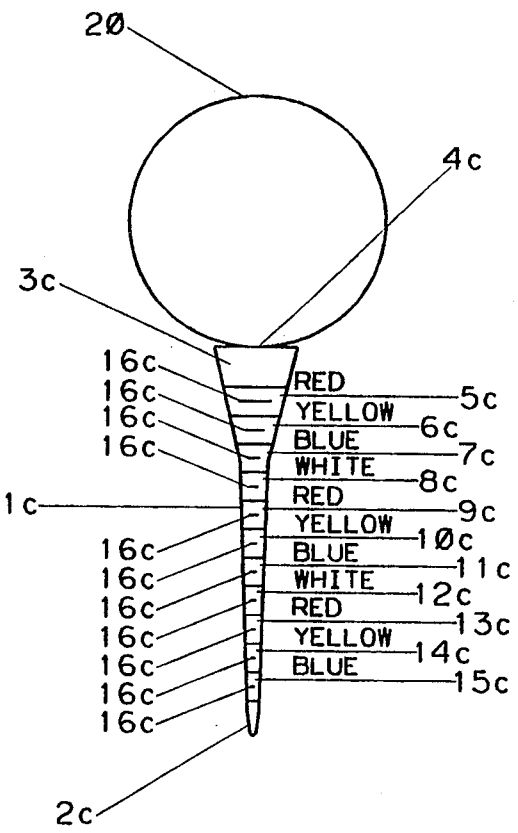
FIG. 1C shows a third species of striped tee in accordance with the invention.

The same conventional unitary body of tee 1 is shown in FIGS. 1A–F. It has a circular cross section about its central axis, is elongated along its central axis, has a pointed tip 2 for penetrating earth, and a head 4 cupped to support a golf ball 20. The tee 1 shown in FIG. 1A has a two color spacing pattern or series on a typical standard long golf tee. The standard long golf tee being manufactured at approximately fifty five millimeters in length from the top of the tee 4, where the ball rests, to the bottom or tip of the tee 2 provided to more easily penetrate the ground.

From the top of the tee 4 to the first spacing 5 (referred to as the buffer 3) would be five or six millimeters. It is not necessary to have spaces on the buffer 3 area, since golfers would rarely, if ever, choose to tee the ball this low.

A plurality of sparings 5–15 would typically be four millimeters in width completely encircling and arranged precisely and evenly along the shaft 1 of the tee. Slightly larger or smaller width spacings could reasonably be used while still maintaining the basic principles of this uniquely gauged tee. Reference marks 16 of dots, grooves, lines or other distinguishable markings would be precisely added around tile circumference of the shaft 1 halfway between each spacing 5–15. This mark 16 would effectively be separating each spacing 5–15 into still more, smaller and potentially infinite numbers of spacings or reference points.

The invention would typically be made of wood as is the standard tee of the present. However, practically any rigid or stable material may be used. Examples of plastic, metal, rubber, cardboard, and other rather novel and rare tees have already been manufactured and would be acceptable. Acrylic paint would be the typical substance to color the tee. However, any distinguishable paint or substance could be used providing it remained colorfast and adhearing to the shaft surface (i.e., water colors with a clear polyurethane coating could be used if practical and more cost effective).

Figure 1B:
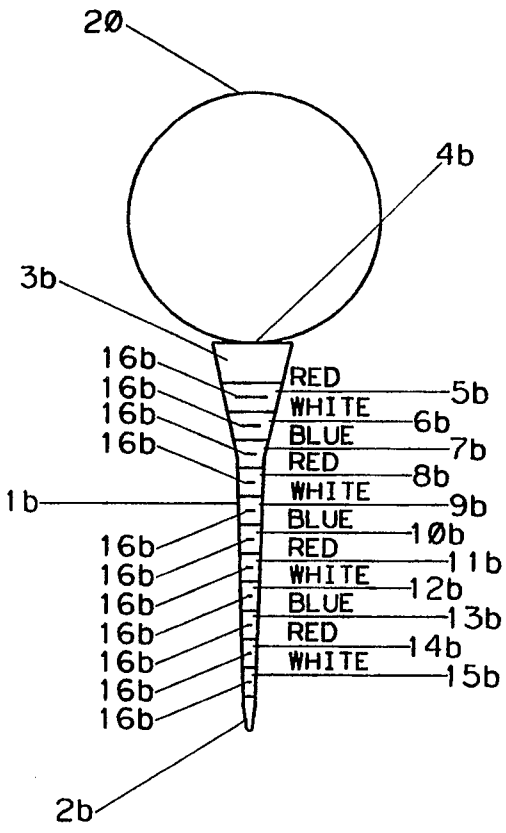
FIG. 1B shows a second species of striped tee in accordance with the invention.
Figure 1A:
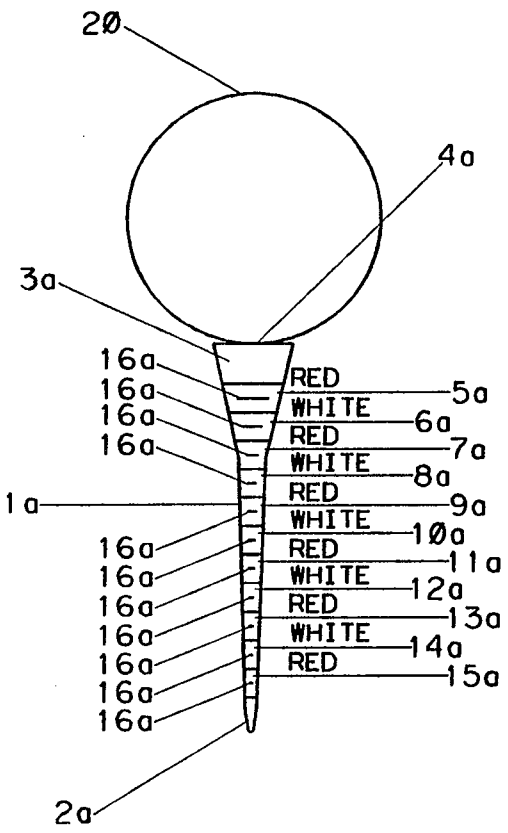
FIG. 1A shows a striped tee in accordance with the invention.
Figure 1F:
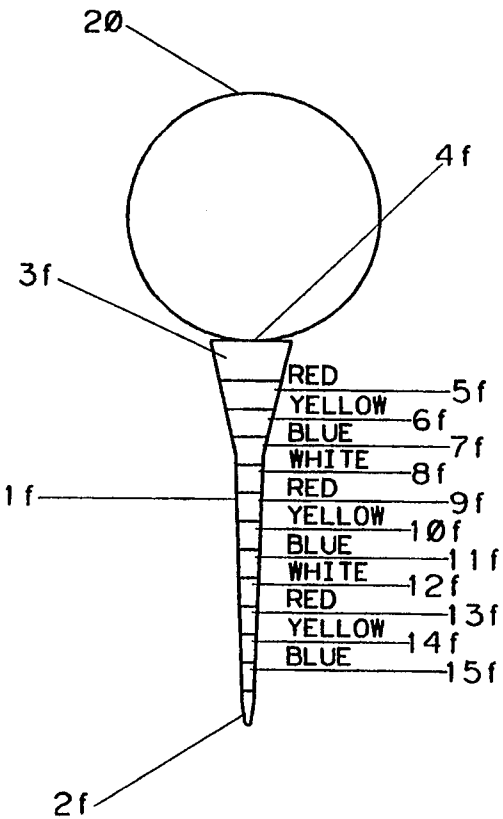
FIG. 1F shows a sixth species of striped tee in accordance with the invention.
Figure 1E:
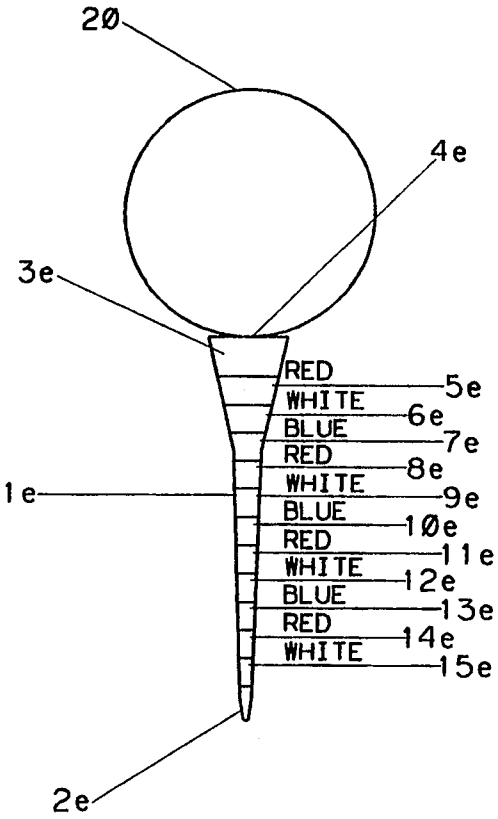
FIG. 1E shows a fifth species of striped tee in accordance with the invention.
Figure 1D:
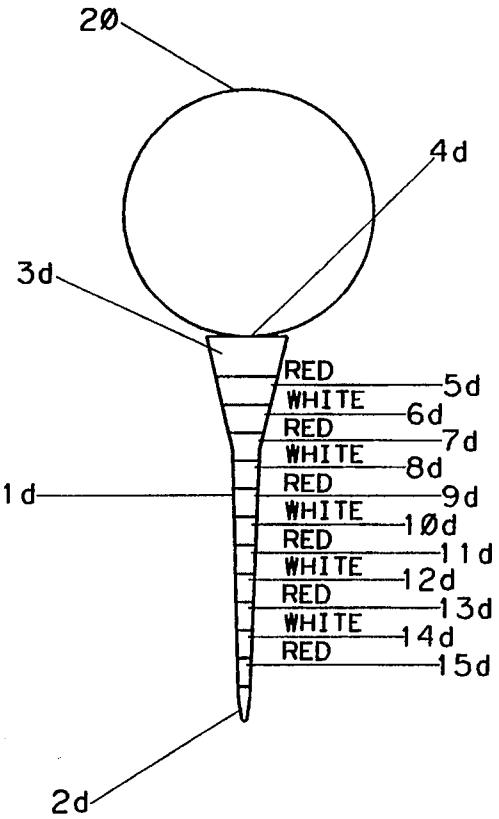
FIG. 1D shows a fourth species of striped tee in accordance with the invention.

Additional embodiments are represented in FIGS. 1B, 1C, 1D, 1E, and 1F. FIGS. 1B and 1C show a three color and four color spacing pattern respectively. FIGS. 1D, 1E, and 1F show tees of two, three, and four color spacing patterns with spacings 5–15 of 4 millimeters in width without the proposed reference marks 16 of FIGS. 1A, 1B, and 1C. Besides the aforementioned representations, there are an almost infinite number of different spacing 5–15 dimensions and color pattern variations which could be used.

The number of practical considerations is limited however, and will become obvious when explained in greater detail in the following "Operation" section.

From the previous description, a number of advantages of my gauged tee become apparent:

(a) The golfer can quickly experiment and determine a constant reference point at which he/she will feel comfortable with when setting the depth of the tee upon teeing off.

(b) The depth of the tee can be easily and definitively be adjusted up or down, which will provide for a pre-calculated degree of change in the trajectory of the ball off the tee upon impact, thus allowing for changing or adverse conditions (i.e., alterations in swing, wind, course topography, obstructions, wet and dry courses, etc.).

(c) The golfer can quickly and easily use the invention without slowing play.

(d) The golfer can practically, precisely and quickly adjust the trajectory of the flight of their ball from the tee without going through a cumbersome and mind-boggling mathematical computation.

(e) With no moving parts employed, the tee will be economical to produce and practical to use.

(f) By being able to correctly set the depth of the tee, golfers will be able to consistently hit more favorable tee shots.

OPERATION: FIGS. 1A–F, FIGS. 2–6

Figure 3:
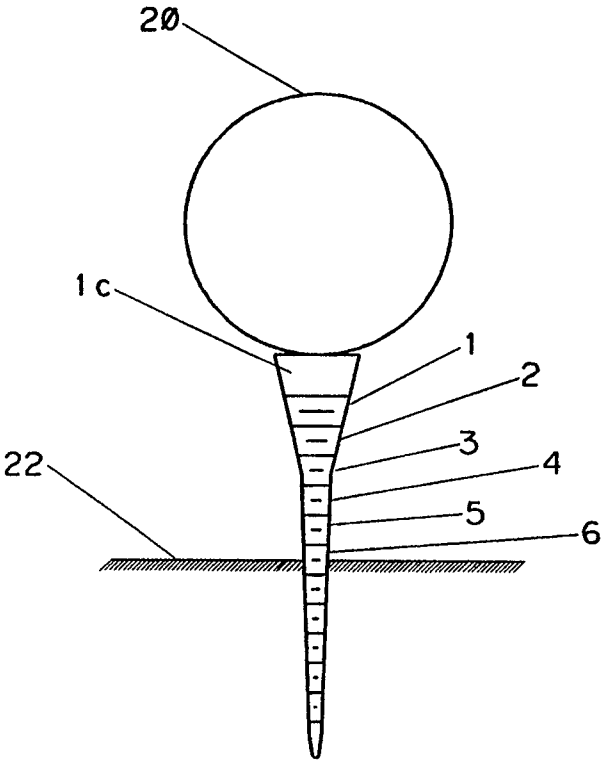
FIG. 2 and 3 show the said second species of striped tee set in the ground at different levels of penetration.
Figure 2:
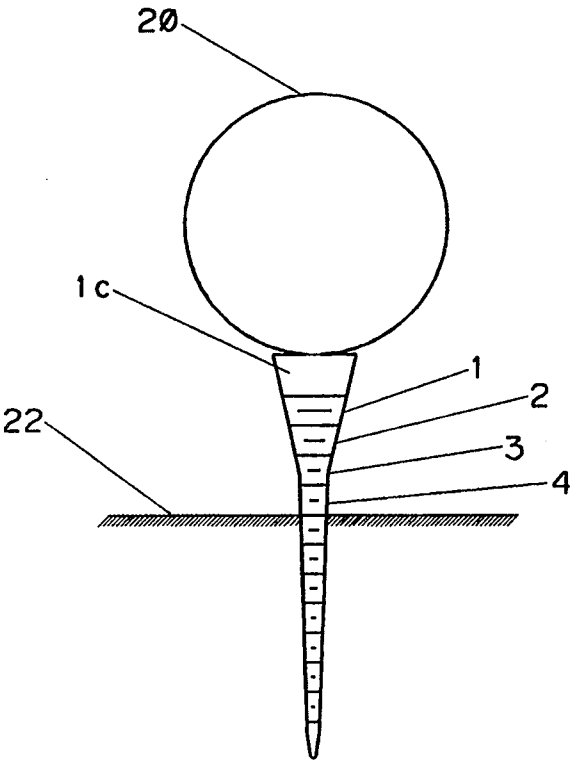

The manner of setting the depth of the gauged tee 1C, for example, is identical to the method employed with conventional tees presently being used. The golfer simply bends over with the ball 20 cupped in his palm, the tee platform 4C touching the ball 20, and the shaft 1C between the middle finger and forefinger. The tip 2C of the shaft 1C is contacted with the ground 22. Force is then applied on the top of the ball, causing the shaft of the tee to submerge into the ground 22, as shown in FIGS. 2 or 3. Once the desired tee depth is reached, the golfer stops applying pressure and gently removes his/her palm from the ball 20.

Figure 4:
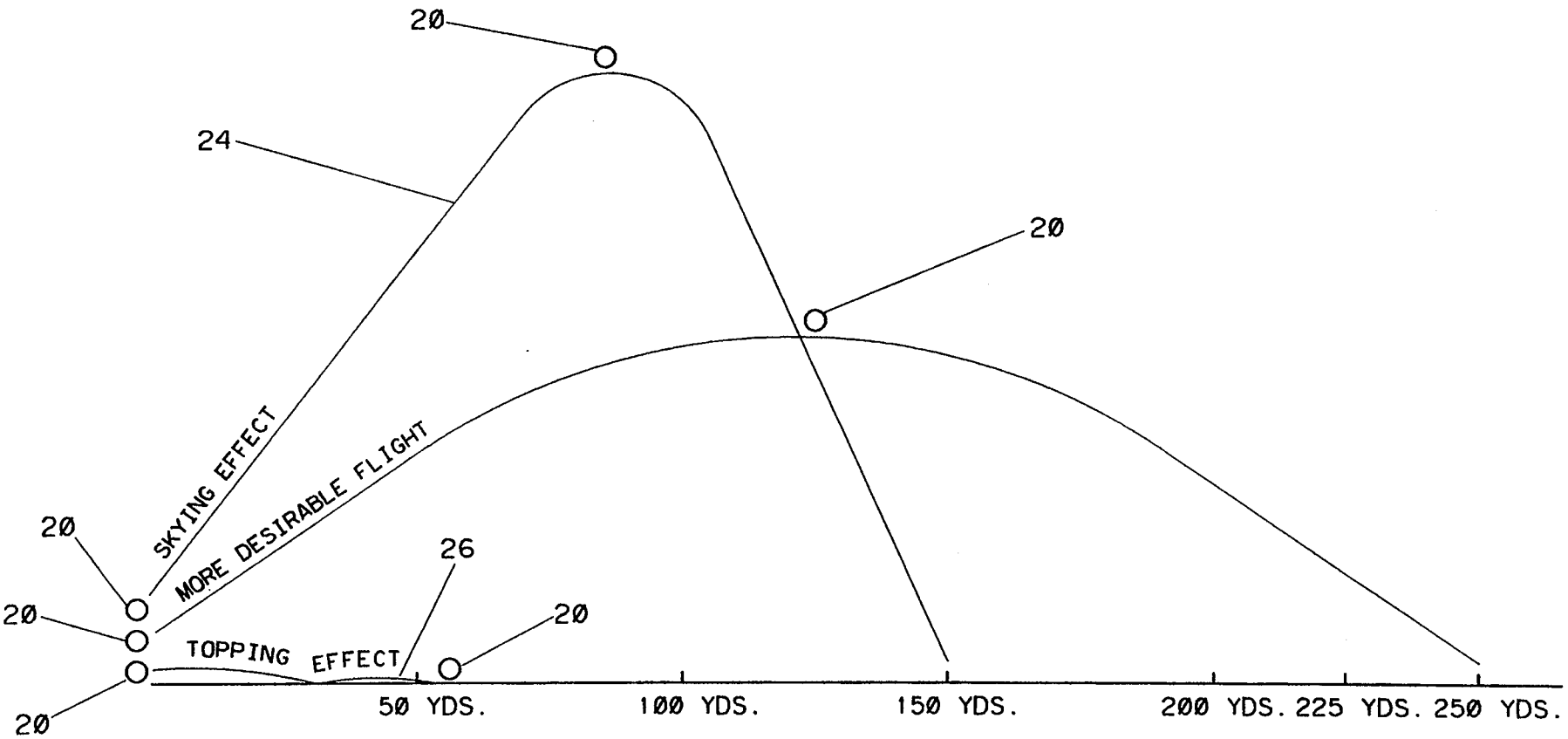
FIG. 4 shows different trajectories of flight of a golf ball when hit from a tee of the invention set in the ground at different heights of the ball from the ground.

Accordingly, the reader will see that the problem with a standard (unmarked and not gauged) tee is that teeing the ball is nothing more than a guessing game which requires constant adjustment. My invention however, eliminates the degree of error in setting one's correct tee depth and reduces the time it takes to do so. By having a constant reference point (that's easy to see and read), a consistent point of impact and trajectory is achieved as shown in FIGS. 2 and 3. Without a constant reference point (as is the case with a standard non-gauged tee), even the slightest variation in tee depth will result in inconsistent and undesirable tee shots (even if the swing is the same from shot to shot). For example, if the tee is placed too far into the ground 22 just slightly, the golfer disproportionately strikes the top part of the ball 20, causing the ball to be "topped", as shown, for example, by the line 26 in FIG. 4. If the tee is similarly not placed far enough in the ground, the golfer disproportionately strikes the bottom part of the ball, or "skys" it, as shown, for example, by the line 24 in FIG. 4.

Figure 5:
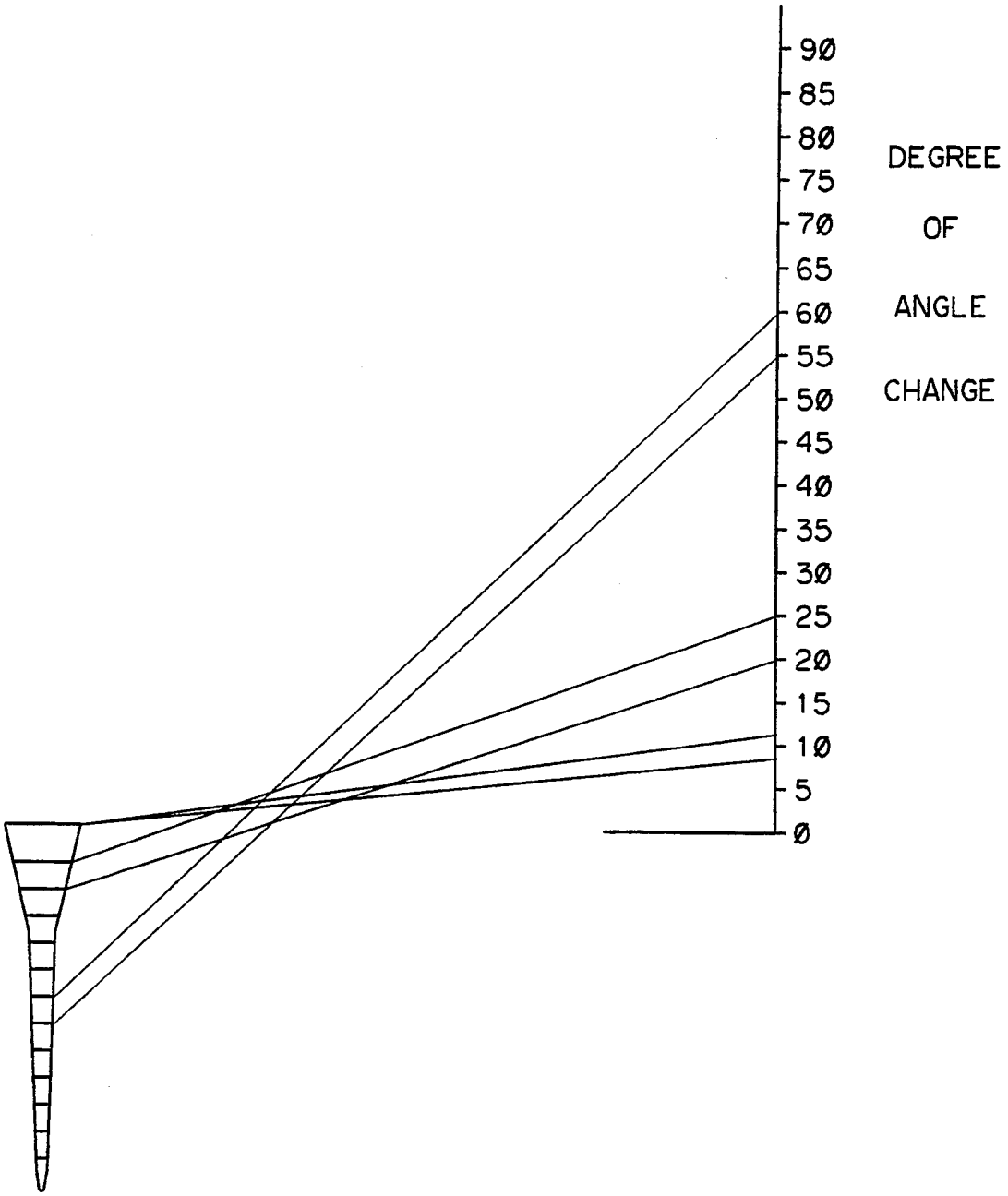
FIG. 5 shows how the angle of a golf ball leaving a striped tee of the invention varies as the number of exposed stripes varies.
Figure 6:
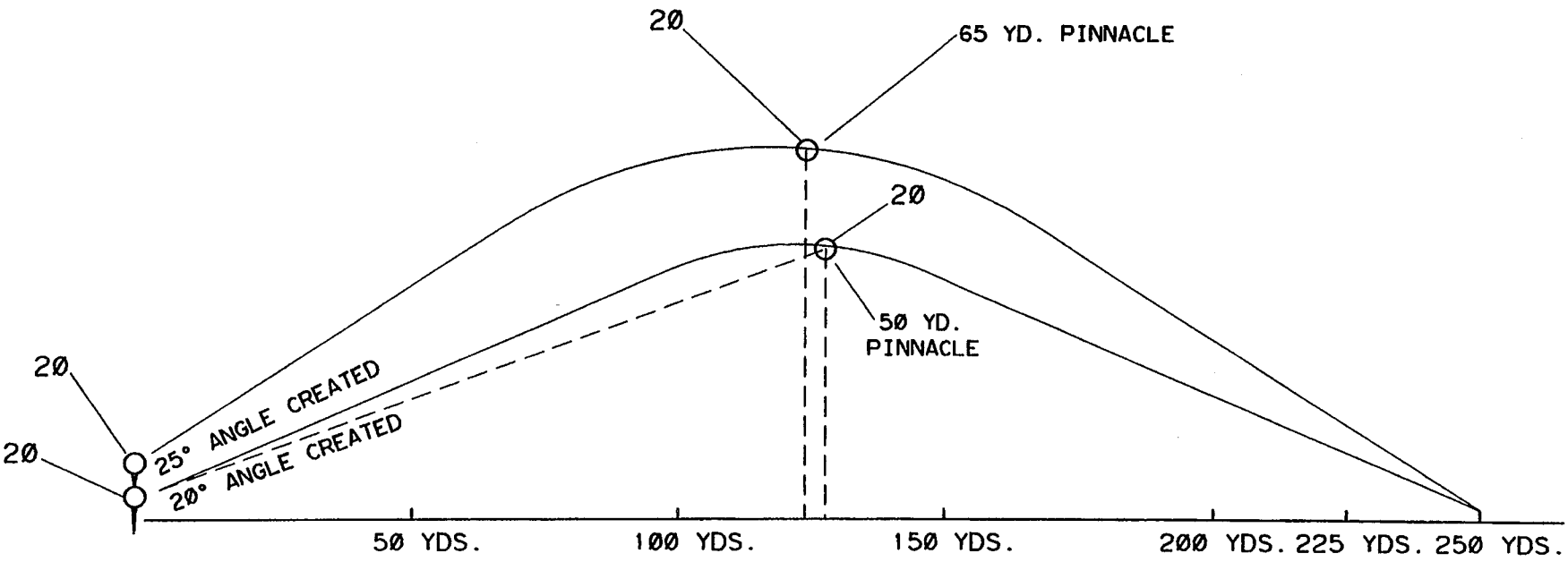
FIG. 6 shows different trajectories of flight of a golf ball when hit from a striped tee of the invention at different angles and ball heights when leaving the tee.

By spacing alternately colored rings evenly and precisely along the shaft 1 of the tee, the tee that I have invented becomes a gauge that's practical and easy to read. My gauged tee enables the golfer to easily and quickly determine the setting (the ring color 5–15) that he/she is comfortable with after just a few tries (either on the practice tee or while playing). In addition, my invention permits golfers to adjust to varying wind conditions. If each colored ring 5–15 is spaced precisely 4 millimeters apart, then each ring up or down computes to a change of 4–6 degrees in the loft of the flight of the ball 20 (see FIG. 5). If for example, the wind is blowing from the golfer's rear, he/she may elect to tee the ball 20 one ring lower than normal (resulting in the ball 20 actually being teed up 4 millimeters higher) as depicted in FIG. 6 (the 250 yard drive represented is approximately 4–6 degrees higher in trajectory, which relates to approximately a 15 yard height increase in the pinnacle of the ball's 20 flight). In comparison, if the golfer is facing the direction of the wind, he/she may tee the ball 20 one ring higher (resulting in the ball 20 actually being teed 4 millimeters lower). The resulting drive is approximately 4–6 degrees lower in trajectory which relates to approximately a 15 yard height decrease in the pinnacle of the ball's flight. Each of these scenarios results in a longer and more advantageous drive than would have normally occurred under these conditions without the use of my striped and gauged golf tee. Also, my invention is perfect for today's golf courses. Due to the universal use and maintenance of dense, low cropped bluegrasses and warm season grasses (i.e., Zoysia, Bermuda), the teeing areas are virtually identical from course to course. Furthermore, the colored and striped gauged golf tee has the additional advantages in that

- it permits golfers to hit a higher percentage of favorable tee shots;
- it permits golfers to effectively adjust to varying course conditions;
- it permits golfers to effectively control the height of their tee shots;
- it permits golfers to easily use a gauged golf tee;
- it permits golfers to tee the ball at the exact same height from hole to hole as well as course to course;
- it allows golfers to feel more confident when teeing off;
- it is very simple and inexpensive to manufacture;
- all golfers can benefit from it;
- all golfers can easily adopt it to their own unique golf swing; and
- the colored settings are easy to read;

Marks on the tee in accordance with the invention may also take the form of circles of discontinuous indicia, such as intermittent lengths of striping or other periodic works which are of like appearance in each circle, but of contrasting appearance in adjacent circles. Contrasting appearance may result from shape or texture, such as ribs around the tee, as well as or instead of color. Black and white are meant to be included as colors for purposes of the invention. Although the description above contains many specifics, these should not be construed as limiting the scope of the invention but as merely providing illustrations of some of the presently preferred embodiments of this invention. Thus the scope of the invention should be determined by the appended claims and their legal equivalents, rather than by just the examples given.

I claim:

1. A golf tee comprising a unitary and substantially rigid body having a head at one end of the tee for supporting a golf ball and an elongated shaft extending from the head to the other end of the body, the shaft being capable of being embedded to different depths to support a golf ball on the tee, and means for gauging the above-ground height of a golf ball on the tee when part of the shaft is embedded, said means comprising colored stripes which are visible and extend in side-by-side relation around the shaft and along a large part of its length, said stripes being arranged in at least two side-by-side series of stripes, each of said series being the same and comprising at least two stripes, and each stripe of the same series having a color which is different from and contrasts with the color of each other stripe of the same series, whereby the contrasting appearance of exposed stripes of the same color helps to determine their number at a glance when the shaft is partly embedded to support a golf ball, and thereby helps to determine the above-ground height of the ball.

* * * * *